US009721741B2

(12) United States Patent
Shiinoki et al.

(10) Patent No.: US 9,721,741 B2
(45) Date of Patent: Aug. 1, 2017

(54) ELECTROMAGNETIC CONTACTOR

(71) Applicant: FUJI ELECTRIC FA COMPONENTS & SYSTEMS CO., LTD., Tokyo (JP)

(72) Inventors: Shota Shiinoki, Tokyo (JP); Masaaki Watanabe, Tokyo (JP); Hideki Daijima, Tokyo (JP); Takashi Tsutsumi, Tokyo (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 15/066,365

(22) Filed: Mar. 10, 2016

(65) Prior Publication Data

US 2016/0189899 A1 Jun. 30, 2016

Related U.S. Application Data

(63) Continuation of application No. PCT/JP2015/001944, filed on Apr. 7, 2015.

(30) Foreign Application Priority Data

May 20, 2014 (JP) ..... 2014-104746

(51) Int. Cl.
*H01H 50/04* (2006.01)
*H01H 51/22* (2006.01)
(Continued)

(52) U.S. Cl.
CPC ..... *H01H 50/047* (2013.01); *H01H 50/646* (2013.01); *H01H 51/2209* (2013.01);
(Continued)

(58) Field of Classification Search
CPC ..... H01H 2221/066; H01H 50/047; H01H 50/20; H01H 51/2209; H01H 2050/225; H01H 50/546; H01H 50/646
See application file for complete search history.

(56) References Cited

U.S. PATENT DOCUMENTS 4,947,146 A * 8/1990 Ichimura ..... H01H 51/2209 335/131
2012/0056701 A1* 3/2012 Takaya ..... H01H 50/045 335/185
2016/0365211 A1* 12/2016 Tsutsumi ..... H01H 45/04

FOREIGN PATENT DOCUMENTS

JP 64-24333 1/1989
JP 8-138509 5/1996
(Continued)

OTHER PUBLICATIONS

International Preliminary Report on Patentability mailed Dec. 1, 2016 in corresponding International Patent Application No. PCT/JP2015/001944.
(Continued)

*Primary Examiner* — Bernard Rojas

(57) ABSTRACT

An electromagnetic contactor capable of coupling either one of an alternating current (AC) electromagnet or a direct current (DC) electromagnet with an identical contact support is provided. The electromagnetic contactor includes an electromagnet including either one of the AC electromagnet (12AC) including a movable core or the DC electromagnet (12DC) including an armature, and a contact support (36) configured to hold plural movable contacts in alignment to be coupled with and driven by the electromagnet. The contact support includes a coupling portion (40) including a movable core contact portion (41), coupling spring edge accommodation portions (46), and armature contact portions (51) arranged on opposite sides with respect to the movable core contact portion of the coupling spring edge accommo-
(Continued)

dation portion. The AC electromagnet (12AC) includes an AC electromagnet coupling spring (56) and the DC electromagnet (12DC) includes a DC electromagnet coupling spring (161).

13 Claims, 11 Drawing Sheets

(51) Int. Cl.
*H01H 50/64* (2006.01)
*H01H 50/54* (2006.01)
*H01H 50/22* (2006.01)

(52) U.S. Cl.
CPC ..... *H01H 50/546* (2013.01); *H01H 2050/225* (2013.01); *H01H 2221/066* (2013.01)

(56) References Cited

FOREIGN PATENT DOCUMENTS

| | | |
|---|---|---|
| JP | 8-250004 | 9/1996 |
| JP | 9-204866 | 8/1997 |
| JP | 2006-216437 | 8/2006 |
| JP | 2008-277010 | 11/2008 |
| JP | 2012-15088 | 1/2012 |

OTHER PUBLICATIONS

International Search Report mailed Jun. 30, 2015, in corresponding International Application No. PCT/JP2015/001944.

* cited by examiner

ELECTROMAGNETIC CONTACTOR

CROSS-REFERENCE TO RELATED APPLICATIONS

This application is a continuation application filed under 35 U.S.C. §111(a) of International Patent Application No. PCT/JP2015/001944, filed Apr. 7, 2015, which claims the foreign priority benefit under 35 U.S.C. §119 of Japanese Patent Application No. 2014-104746, filed May 20, 2014, the contents of which are incorporated herein by reference.

TECHNICAL FIELD

The present invention is related to an electromagnetic contactor including an electromagnet including either one of an alternating current (AC) electromagnet including a movable core or a direct current (DC) electromagnet including an armature, and a contact support configured to hold plural movable contacts in alignment to be coupled with and driven by the electromagnet.

BACKGROUND ART

As the electromagnetic contactor of this type, there are proposals for an electromagnetic contactor in which a contact support is driven by an AC electromagnet disclosed in, for example, Patent Literature 1, and another electromagnetic contactor in which the contact support is driven by a DC electromagnet disclosed in, for example, Patent Literature 2.

In addition, as disclosed in patent Literature 3, there is a proposal for yet another electromagnetic contactor that enables a configuration of the DC operated electromagnetic contactor with both of the AC and DC operated electromagnetic contactors used as a base.

CITATION LIST

Patent Literature

PLT 1: JP 2008-277010 A
PLT 2: JP 2012-15088 A
PLT 3: JP 2006-216437 A

SUMMARY

Technical Problem

Regarding the above known electromagnetic contactors, however, in comparing a case where the AC electromagnet is applied with a case where the DC electromagnet is applied, as an electromagnet for driving the contact support, the DC electromagnet is higher in height than the AC electromagnet. Hence, as illustrated in patent Literature 3, an intermediate frame has to be additionally arranged between the top and bottom frames.

Thus, when the AC electromagnet is coupled with an identical contact support, or when the DC electromagnet is coupled with the identical contact support, they cannot be accommodated in an identical frame and an intermediate frame for the DC electromagnet has to be used. Hence, there is an unsolved problem that the AC electromagnet and the DC electromagnet cannot commonly use the frame itself.

Therefore, the present invention has been made in view of the above unsolved problem of the known examples, and has an object of providing an electromagnetic contactor capable of coupling the AC electromagnet or the DC electromagnet with an identical contact support.

Solution to Problem

In order to achieve the above object, an electromagnetic contactor according to one aspect of the present invention includes an electromagnet including either one of an alternating current (AC) electromagnet including a movable core or a direct current (DC) electromagnet including an armature, and a contact support configured to hold a plurality of movable contacts in alignment to be coupled with the electromagnet and driven by the electromagnet.

The contact support includes a coupling portion including, at a coupling face of the electromagnet: a movable core contact portion extending in a direction crossing an alignment direction of the plurality of movable contacts with which a mounting face of the movable core of the AC electromagnet is in contact, coupling spring edge accommodation portions arranged on both sides of the movable core contact portion, and at least the movable core contact portion and one of end parts in an extension direction of the movable core contact portion being opened; and armature contact portions arranged on opposite sides with respect to the movable core contact portion of the coupling spring edge accommodation portion, with which the armature of the DC electromagnet is in contact. In addition, the AC electromagnet includes an AC electromagnet coupling spring to be inserted into a through hole arranged on the mounting face of the movable core, and the DC electromagnet includes a DC electromagnet coupling spring arranged at a contact face of the armature to be in contact with the armature contact portion.

Advantageous Effects

According to the present invention, either one of the AC electromagnet coupling spring arranged at the movable core of the AC electromagnet or the DC electromagnet coupling spring arranged at the armature of the DC electromagnet is configured to be accommodated at the coupling portion arranged at the contact support, so that the identical contact support can be commonly used in applying the AC electromagnet and in applying the DC electromagnet. Accordingly, this configuration eliminates the need of individually forming the contact supports for both of the AC electromagnet and the DC electromagnet, and the cost of the electromagnetic contactor can be reduced by commonly using the parts.

DESCRIPTION OF EMBODIMENTS

Hereinafter, embodiments of the present invention will be described with reference to the accompanied drawings.

Figure 1:
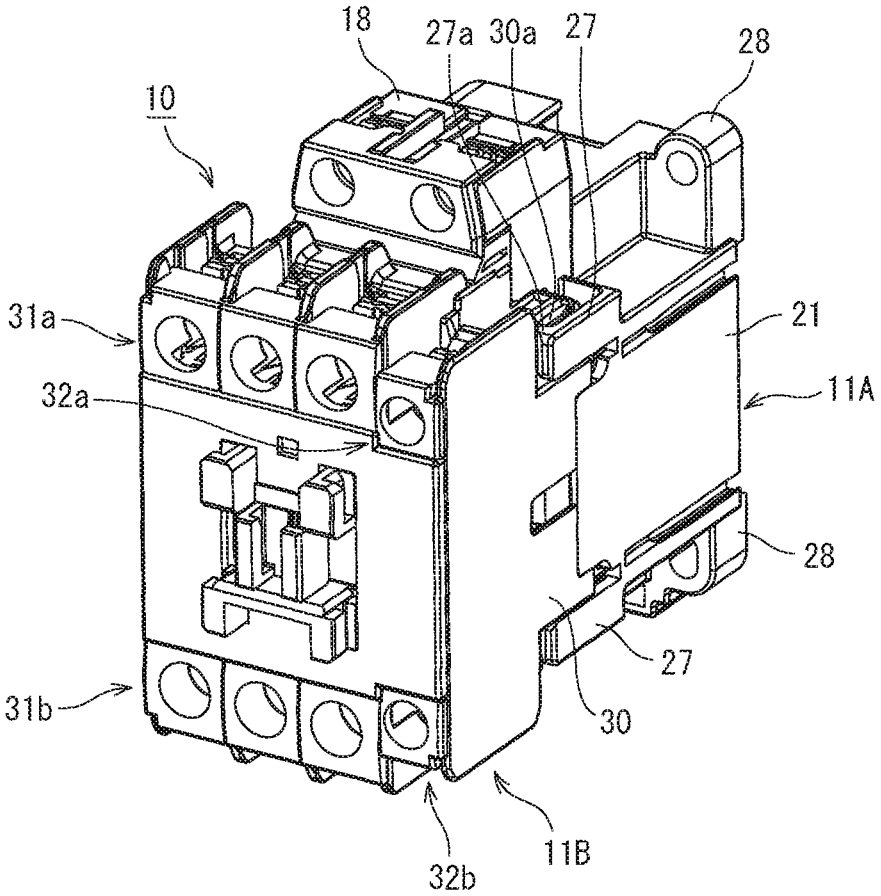
FIG. 1 is a perspective view illustrating an electromagnetic contactor in the present invention.

Referring to FIG. 1, an electromagnetic contactor 10 in the present invention is configured such that a first frame 11A and a second frame 11B made of a synthetic resin material, for example, polybutylene terephthalate (PBT) are coupled with each other.

Figure 3:
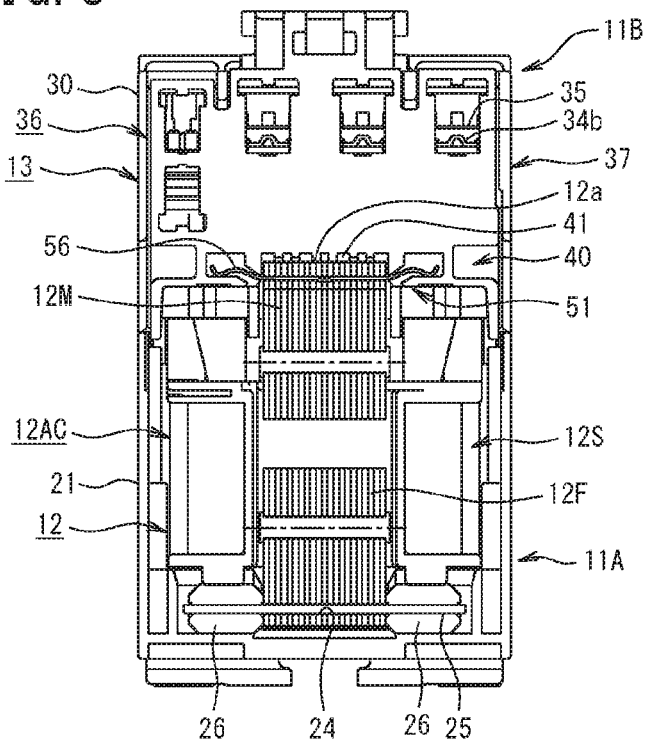
FIG. 3 is a cross-sectional view taken along the line III-III of FIG. 2.
Figure 4:
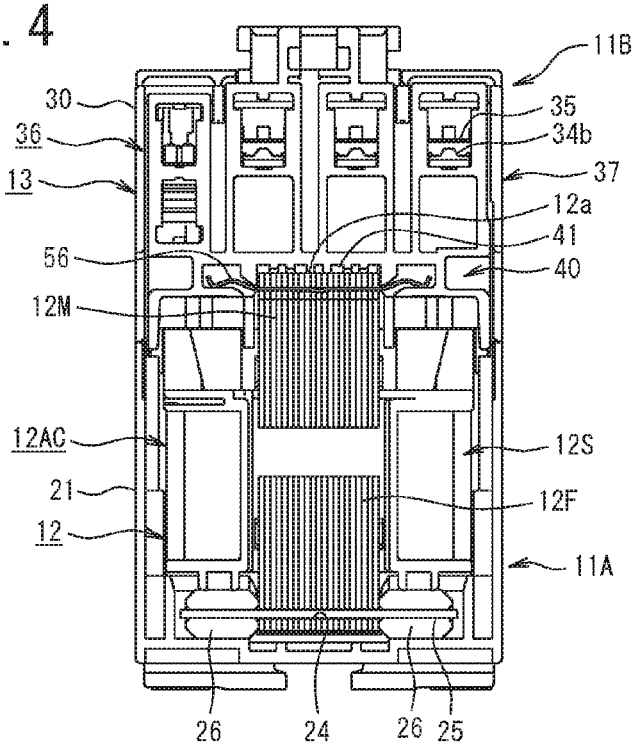
FIG. 4 is a cross-sectional view taken along the line IV-IV of FIG. 2.

In the first frame 11A, as illustrated in FIG. 3 and FIG. 4, an operated electromagnet 12 is arranged. In the second frame 11B, as illustrated in FIG. 3 and FIG. 4, a contact mechanism 13 to be driven for on and off by the operated electromagnet 12 is arranged.

Referring to FIG. 3 and FIG. 4, the first frame 11A includes a bottomed square tubular portion 21 that accommodates the operated electromagnet 12.

The operated electromagnet 12 is configured with an AC electromagnet 12AC including a stationary core 12F, a movable core 12M capable of advancing or receding with respect to the stationary core 12F, and a spool 12S around which an excitation coil 12*c* is wound.

Figure 5:
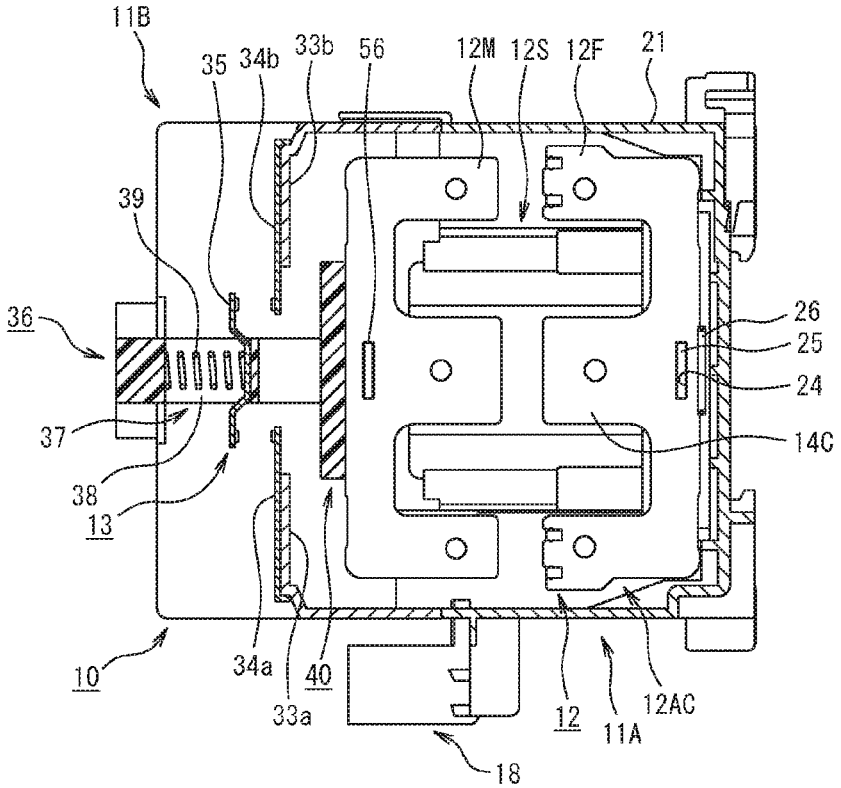
FIG. 5 is a cross-sectional view taken along the line V-V of FIG. 2.

Referring now to FIG. 5, the stationary core 12F is formed to have a letter E shape when viewed from the left side face, and both ends of a support plate 25 that is inserted through a through hole 24 arranged at a central part of a vertical panel portion 23*a* are elastically supported by an elastic member 26 fixed at the bottom of the bottomed square tubular portion 21.

The movable core 12M is formed to have a letter E shape when viewed from the right side face, as illustrated in FIG. 5, and is coupled with a contact support 36, as will be described later, supported movably in front-rear direction in the second frame 11B to be integrally movable with the contact support 36.

Figure 6:
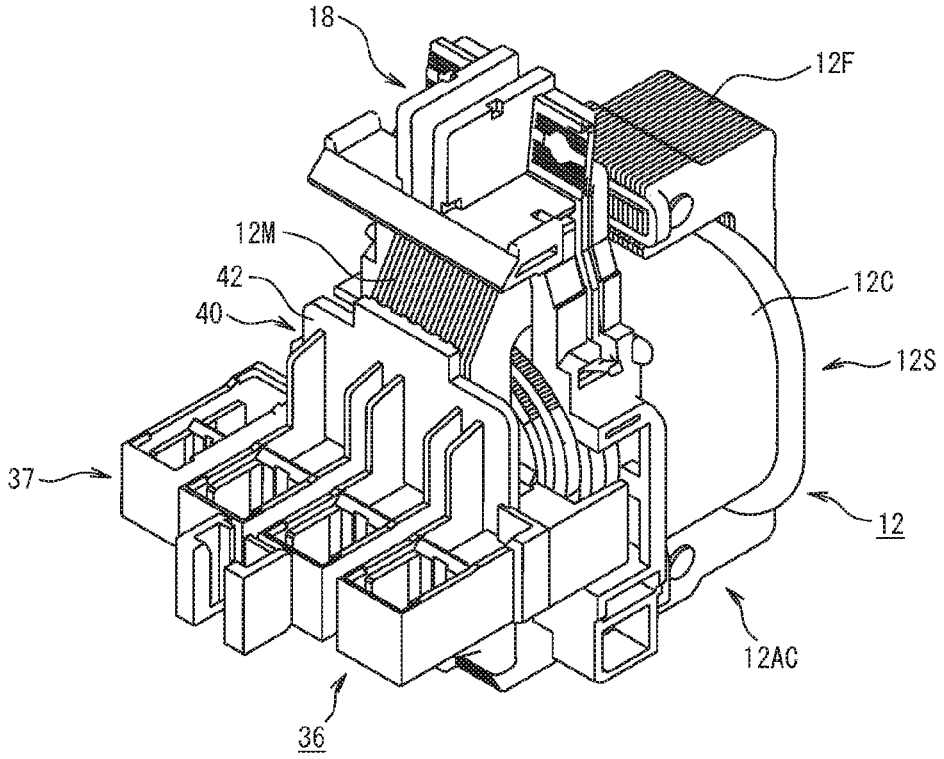
FIG. 6 is a perspective view in a case where an AC electromagnet is applied as an electromagnet in the state where the frame of FIG. 1 is removed.
Figure 7:
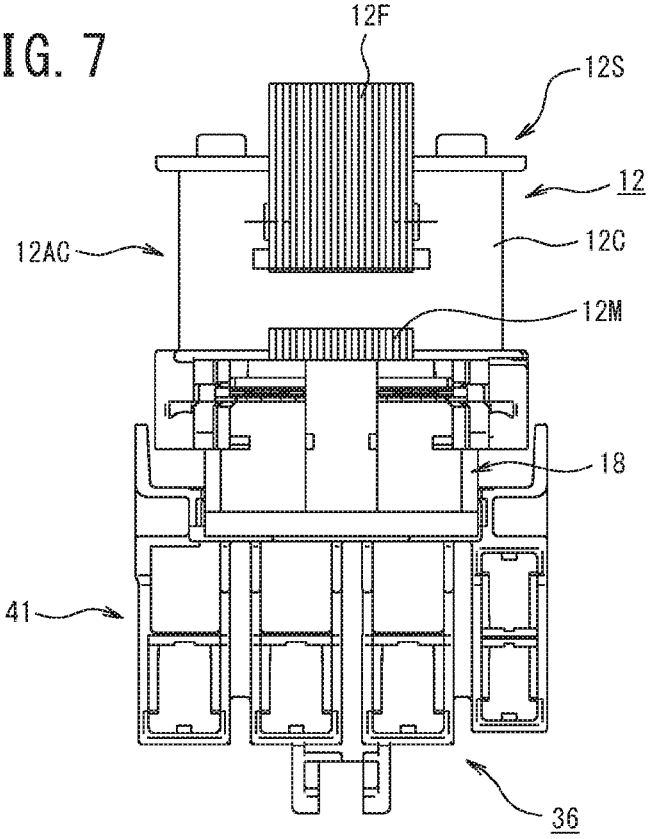
FIG. 7 is a plane view of FIG. 6.

The spool 12S is arranged around a central protrusion portion 14*c* protruding on the front side of the stationary core 12F, as illustrated in FIG. 5. As illustrated in FIG. 6, coil terminals 18 protruding upward are formed at the spool 12S.

In addition, as illustrated in FIG. 1, at the front end of one of opposing side walls, for example, left and right side walls of the bottomed square tubular portion 21 of the first frame 11A, four hook portions 27 included in a snap-fit configuration are arranged at vertically and horizontally symmetric positions to make an engagement portion 27*a* face inward.

Further, mounting plate portions 28 each having a mounting hole are respectively formed at four corners of the bottom of the bottomed square tubular portion 21 of the first frame 11A.

Figure 2:
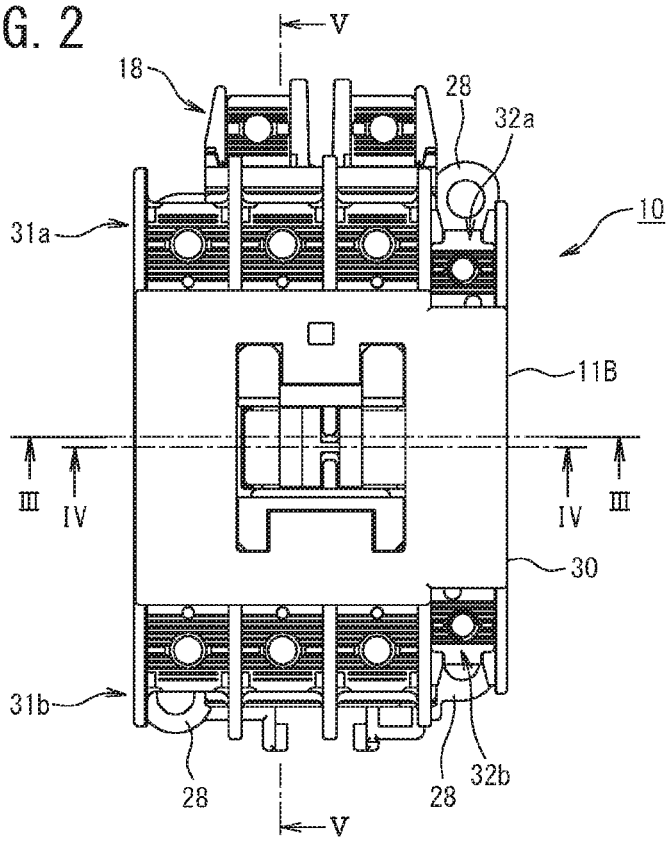
FIG. 2 is a front view of a state where a terminal cover of FIG. 1 is removed.

The second frame 11B includes a square tubular portion 30 having an opened front end opposing the bottomed square tubular portion 21 of the first frame 11A, as illustrated in FIG. 1 and FIG. 2.

The front face side of the square tubular portion 30 includes a power supply side terminal portion 31*a* and an auxiliary terminal portion 32*a* that are formed on the upper side, and a load side terminal portion 31*b* and an auxiliary terminal portion 32*b* that are formed on the lower side. The contact mechanism 13 is arranged in the square tubular portion 30. Moreover, as illustrated in FIG. 1, an engagement projection portion 30*a* included in the snap-fit configuration to be engaged with the hook member 27 of the first frame 11A is arranged at an opened end face on the rear side of the square tubular portion 30.

As illustrated in FIG. 5, the contact mechanism 13 includes four sets of stationary contacts 34*a* and 34*b* arranged in parallel in a left-right direction and respectively fixed at a pair of contact fixed plate portions 33*a* and 33*b* that respectively extend inward from the upper and lower plate portions of the second frame 11B. In these four sets of stationary contacts 34*a* and 34*b*, the stationary contact 34*a* includes a power supply side terminal portion 31*a* and an auxiliary terminal portion 32*a*, and the stationary contact 34*b* includes a load side terminal portion 31*b* and the auxiliary terminal portion 32*b*.

In addition, the contact mechanism. 13 includes a contact support 36 configured to support four sets of movable contacts 35 to oppose from the front side with a predetermined space being apart from both end parts of the movable contacts 35 to the stationary contacts 34*a* and 34*b*.

Referring to FIG. 3 to FIG. 9, the contact support 36 includes a movable contact support portion 37 configured to hold the four sets of movable contact 35 in alignment to be movable in the front-rear direction, and an electromagnet coupling portion 40 integrally formed on the rear side of the movable contact support portion 37.

As illustrated in FIG. 5, the movable contact support portion 37 includes a contact inserting space portion 38 configured to allow insertion and holding of the movable contact 35, such that the movable contact 35 is pushed rearward by a contact spring 39 and is supported in the contact inserting space portion 38.

Figure 11:
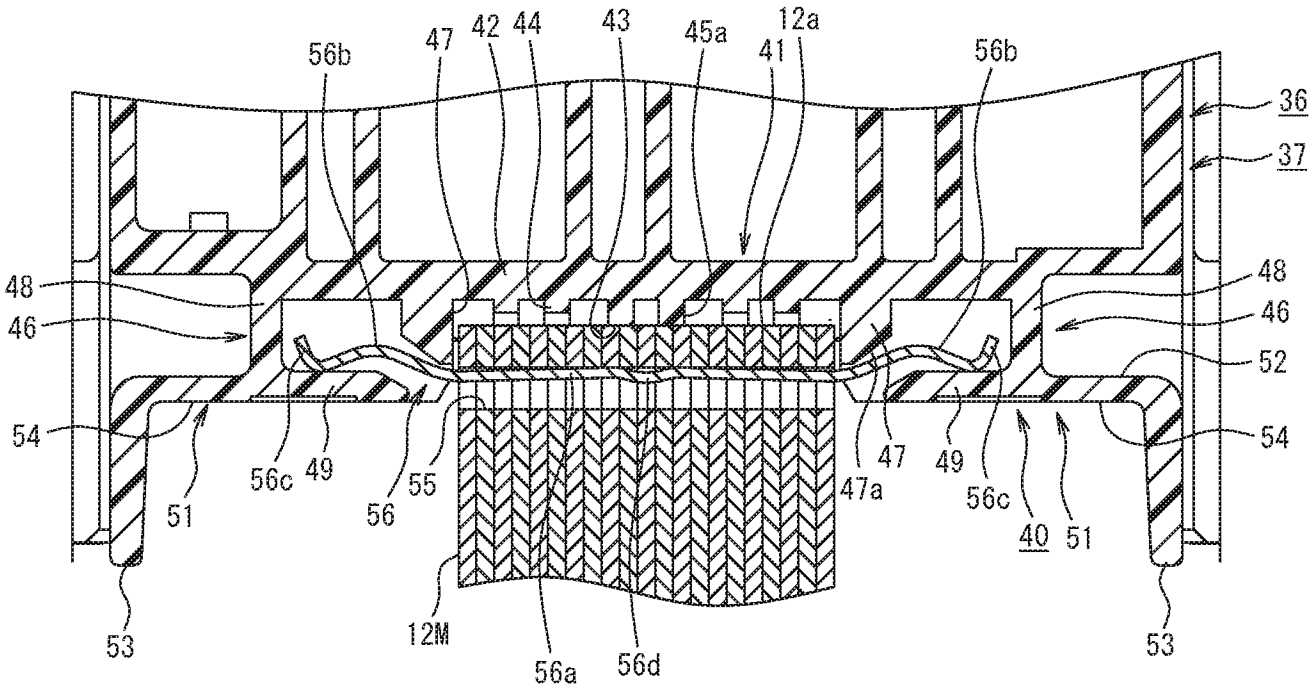
FIG. 11 is an enlarged cross-sectional view of an electromagnet coupling portion of the contact support.

Referring to an enlarged view of FIG. 11, the electromagnet coupling portion 40 includes a movable core contact portion 41 with which a movable core 12M of the AC electromagnet 12AC is in contact, coupling spring edge accommodation portions 46, and armature contact portions 51 with which an armature of the DC electromagnet is in contact.

Figure 8:
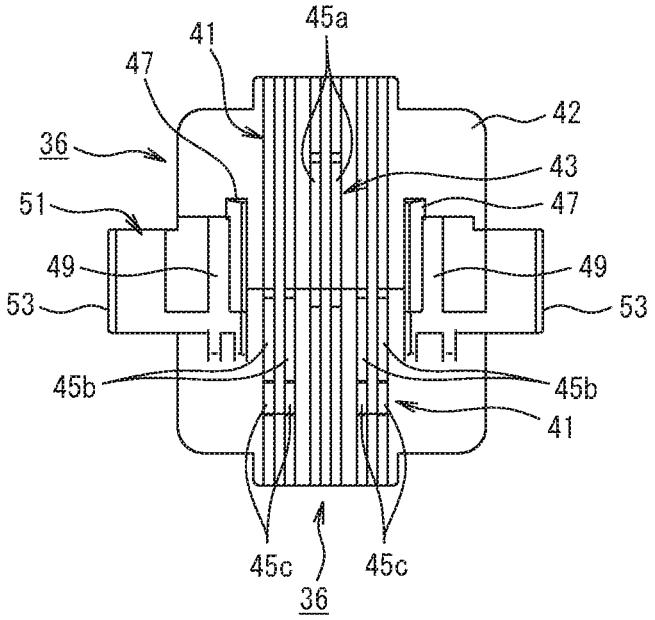
FIG. 8 is a bottom view of a contact support.
Figure 9:
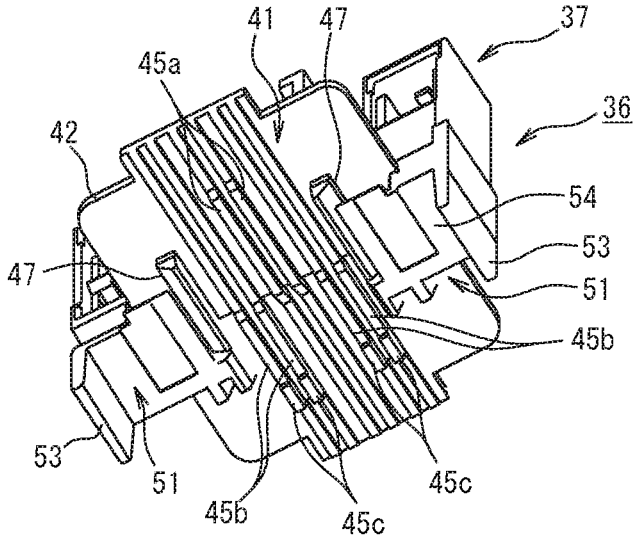
FIG. 9 is a perspective view when viewed from a bottom face side of the contact support.

As illustrated in FIG. 8 and FIG. 9, the movable core contact portion 41 includes a substrate portion 42 that extends in an up-down direction crossing the alignment direction of the movable contacts 35 formed integrally on the rear end side of the movable contact support portion 37, and a movable core contact face 43 is arranged at an end face on the rear face side of the substrate portion 42. The movable core contact face 43 includes plural, for example, six lines of projections 44 formed along a sliding direction in fixing the movable core 12M. In these projections 44, two projections 44 on the inner side respectively include movable core contact projections 45*a* that further project frontward on the sliding start side of the movable core 12M, and two projections 44 on each of the outer sides include movable core contact projections 45*b* at positions that finally fix the movable core 12M. Then, stopper portions 45*c* to be in contact with and position the movable core 12M are arranged on the lower side of the movable core contact projection 45*b*.

The coupling spring edge accommodation portions 46 are arranged along both left and right sides of the movable core contact portion 41, respectively, as illustrated in FIG. 11. The coupling spring edge accommodation portions 46 include partitions 47 arranged on both left and right sides of the movable core contact portion 41, partitions 48 arranged on the outer sides of the partitions 47 with predetermined spaces being kept respectively, and spring support plate portions 49 that extend toward the partitions 47 from the front end faces of the partitions 48. Then, spring insertion portions 50 are opened to permit insertion of the coupling spring between the partitions 47 and the spring support plate portions 49, and in addition, one of an upper end part or a lower end part, for example, an upper end part of the spring insertion portion 50 is opened. Further, rear end faces of the partitions 47 respectively include inclined faces 47*a* that decrease the protruding heights as getting closer to the outer sides from the movable core contact portions 41.

The armature contact portions 51 respectively include plate portions 52 that extend on both of left and right outer sides from the partition 48 sides of the spring support plate portions 49 of the coupling spring edge accommodation portions 46, and plate portions 53 that bend backward from both of left and right ends of the plate portions 52 and then extend. Then, the rear faces of the plate portions 52 including rear faces of the spring support plate portions 49 correspond to armature contact faces 54.

In this manner, the contact support 36 is capable of coupling either one of the above-described AC electromagnet 12AC or the polarized DC electromagnet 12DC, as will be described later, since in the contact support 36, there are provided the electromagnet coupling portion 40 includes the movable core contact portion 41 with which the movable core 12M of the AC electromagnet 12AC comes into contact, and the armature contact portion 51 with which a first armature 123 of the polarized DC electromagnet 12DC, as will be described later, comes into contact.

Figure 10A:
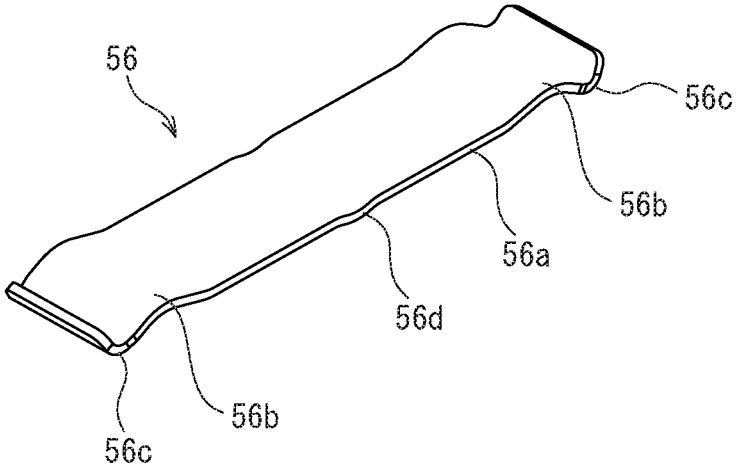
FIG. 10A is a perspective view illustrating a coupling spring of the AC electromagnet.
Figure 10B:
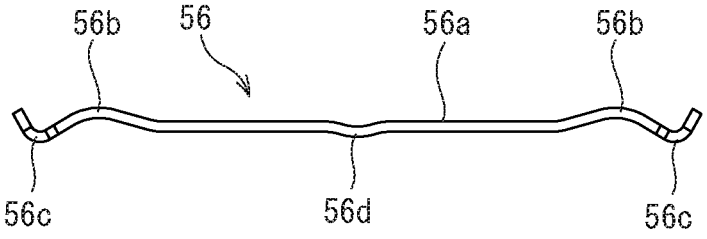
FIG. 10B is a side view illustrating the coupling spring of the AC electromagnet.

In this situation, when the movable core 12M of the AC electromagnet 12AC is coupled with the contact support 36, as illustrated in FIG. 3 and FIG. 4, an AC electromagnet coupling spring 56 illustrated in FIG. 10A and FIG. 10B is inserted into a spring insertion hole 55 arranged and penetrated at a central position in the up-down direction of a vertical plate portion of the movable core 12M, and then upper and lower end parts protruding from the movable core 12M of the AC electromagnet coupling spring 56 are inserted and fixed into the coupling spring edge accommodation portion 46.

Then, the AC electromagnet coupling spring 56 includes, as illustrated in FIG. 10A and FIG. 10B, a flat plate portion 56*a* at the central part, curved bulge portions 56*b*, respectively arranged on both end sides of the flat plat portion 56*a*, corresponding to curved plate portions, and edge curved bulge portions 56*c* respectively arranged on both sides of the curved bulge portions 56*b*.

The flat plate portion 56*a* includes a central curved bulge portion 56*d* that protrudes downward at the central portion in the longer direction and that extends in a direction that is perpendicular to the longer direction. The length in the longer direction of the flat plate portion 56*a* is set to be substantially equal to a width of the movable core 12M, as illustrated in FIG. 3 and FIG. 4. The curved bulge portions 56*b* are integrally formed with both ends in the longer direction of the flat plate portion 56*a*, respectively, protrude upward with being curved, and extend in a direction that is perpendicular to the longer direction of the flat plate portion 56*a*. The edge curved bulge portions 56*c* are integrally formed with both of left and right end parts of the curved bulge portions 56*b*, respectively, curve downward to protrude, and extend in the direction that is perpendicular to the longer direction of the flat plate portion 56*a*.

Then, in order to couple the contact support 36 and the movable core 12M of the AC electromagnet 12AC, the flat plate portion 56*a* of the AC electromagnet coupling spring 56 is inserted into the spring insertion hole 55 arranged to be penetrated in the movable core 12M, so that the central curved bulge portion 56*d* is arranged on a reverse side to a contact face 12*a* side of the movable core 12M, the contact face 12*a* being in contact with the movable core contact face 43 of the contact support 36. In this situation, the curved bulge portions 56*b* and the edge curved bulge portions 56*c* respectively protrude from left and right side faces of the movable core 12M.

In this state, firstly, the contact face 12*a* of the movable core 12M is brought into contact with the movable core contact projections 45*a* on the edge side in the movable core contact portion 41 of the electromagnet coupling portion 40 of the contact support 36. In this state, the curved bulge portions 56*b* and the edge curved bulge portions 56*c* of the AC electromagnet coupling spring 56 oppose the coupling spring edge accommodation portion 46 of the contact support 36 from the upper end side.

Subsequently, while sliding the movable core 12M downward, the curved bulge portions 56*b* of the AC electromagnet coupling spring 56 are respectively opposed to the inclined faces 47*a* of the partitions 47, and in addition, the edge curved bulge portions 56*c* are engaged with the inner faces of the spring support plate portions 49. In this situation, since the movable core contact projections 45*a* are arranged only at the central part in the left-right direction of the board portion 42, the movable core 12M can be inclined when the movable core 12M is brought into contact with the movable core contact projections 45*a*. Therefore, by inclining the movable core 12M alternately, the curved bulge portions 56*b* and the edge curved bulge portions 56*c* of the AC electromagnet coupling spring 56 can be alternately inserted into the left and right coupling spring edge accommodation portions 46. Thus, it is possible to easily insert the AC electromagnet coupling spring 56 into the coupling spring edge accommodation portion 46.

Further, the movable core 12M is made to slide further downward, the contact face 12*a* of the movable core 12M comes into contact with the movable core contact projections 45*b*. Furthermore, sliding of the movable core 12M is stopped at a position that abuts the stopper portion 45*c* of the movable core contact portion 41. Accordingly, as illustrated in FIG. 11, the contact face 12*a* of the movable core 12M is in contact with the movable core contact face 43 of the contact support 36, and the edge curved bulge portions 56*c* of the AC electromagnet coupling spring 56 engage the inner faces of the spring support plate portions 49. Hence, the elasticity of the AC electromagnet coupling spring 56 brings the contact face 12*a* of the movable core 12M into pressure contact with the movable core contact face 43 of the electromagnet coupling portion 40 in the contact support 36. Therefore, the movable core 12M of the AC electromagnet 12AC is coupled with the contact support 36 via the AC electromagnet coupling spring 56.

Then, the second frame 11B is coupled to the first frame 11A in which the stationary core 12F and the spool 12S are included with the contact support 36 coupled with the movable core 12M being movably supported in the second frame 11B. For coupling the first frame 11A and the second frame 11B in this case, by engaging the hook portions 27 arranged at the first frame 11A with engagement projections 30*a* arranged at the second frame 11B, respectively, the snap-fit configuration is achieved and the electromagnetic contactor 10 is formed.

On the other hand, the identical contact support 36 is capable of coupling either one of a polarized DC electromagnet 12DC or a polarized AC electromagnet 12AC.

Figure 12:
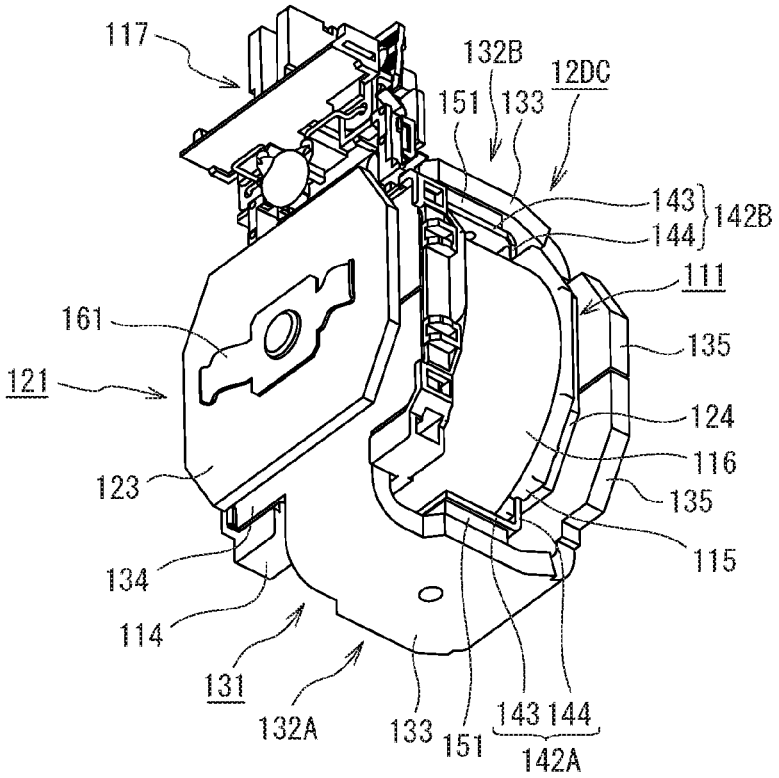
FIG. 12 is a perspective view in a case where a polarized DC electromagnet is applied as the electromagnet in the state where the frame of FIG. 1 is removed.
Figure 13:
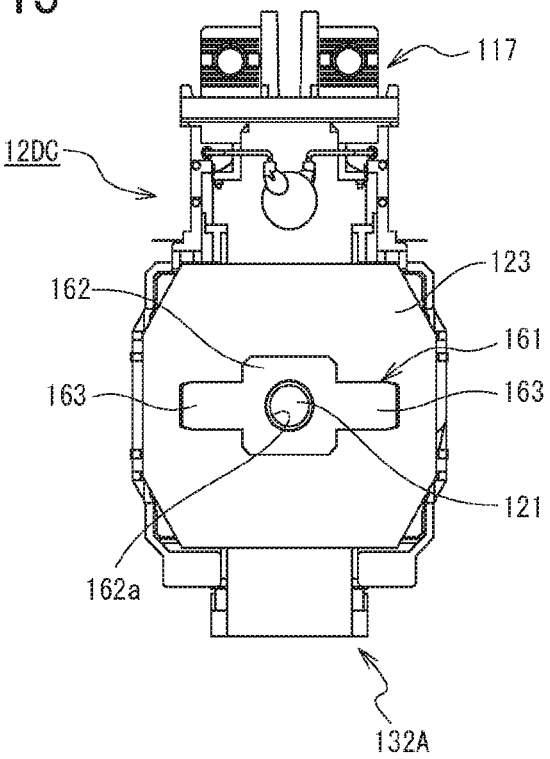
FIG. 13 is a plane view of FIG. 12.
Figure 14:
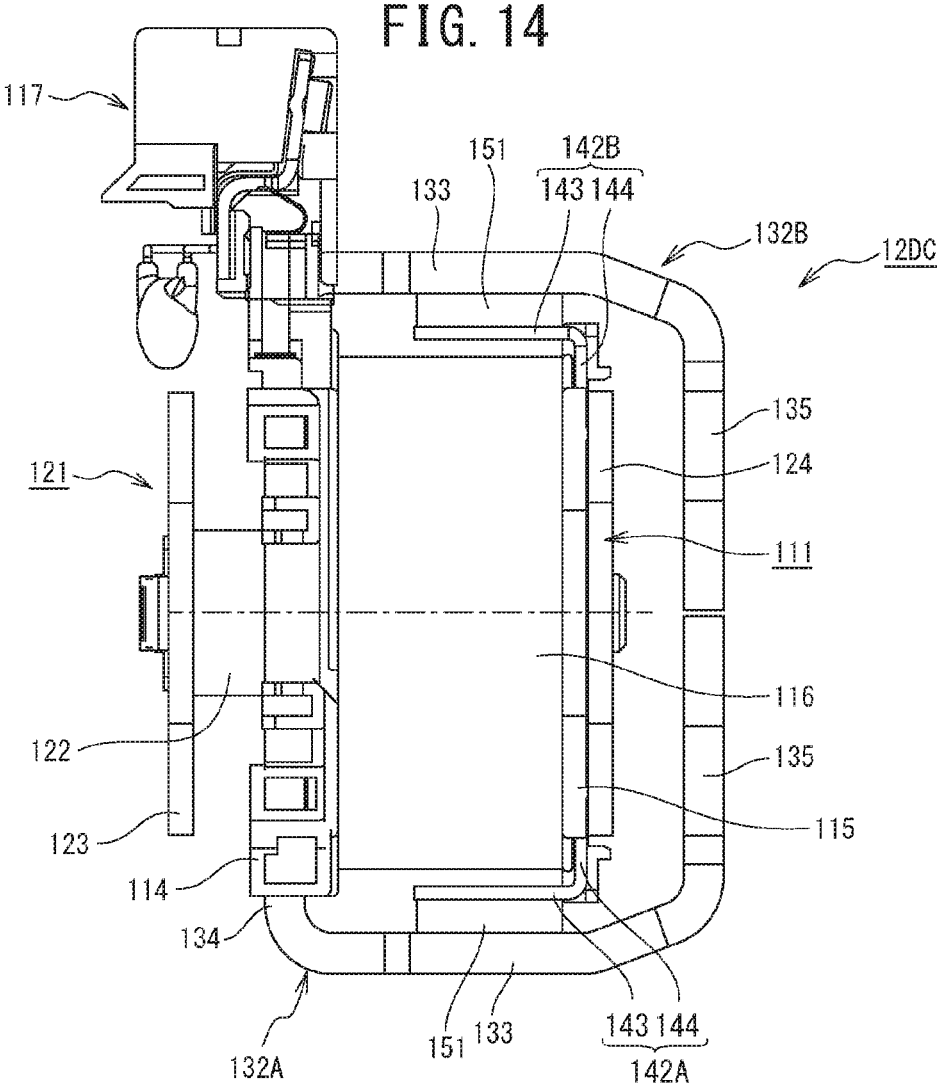
FIG. 14 is a side view of FIG. 12.

As illustrated in FIG. 12 to FIG. 14, the polarized DC electromagnet 12DC according to an embodiment of the present invention includes a spool 111, a plunger 121, an outer yoke 131, an inner yoke 141, and permanent magnets 151.

Figure 17:
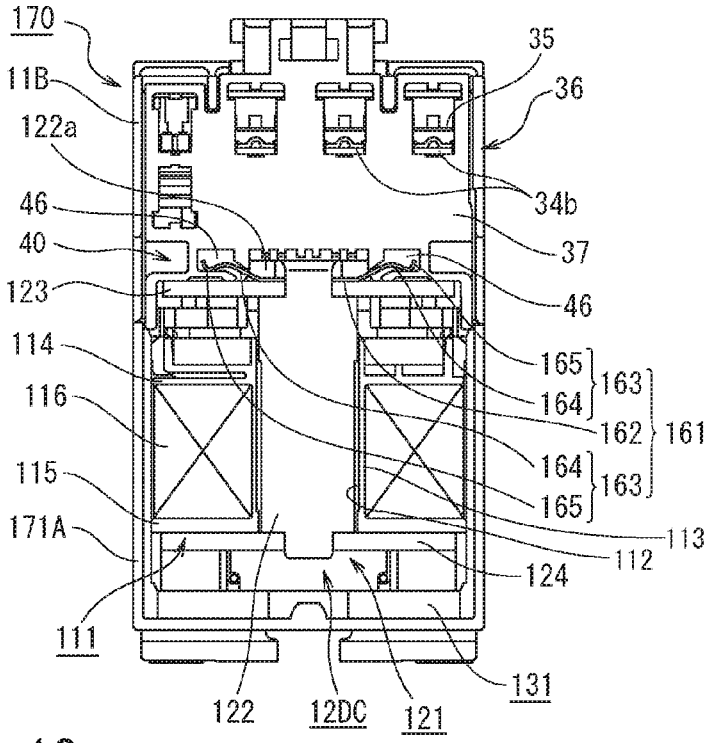
FIG. 17 is a cross-sectional view taken along the line XVII-XVII of FIG. 16.
Figure 18:
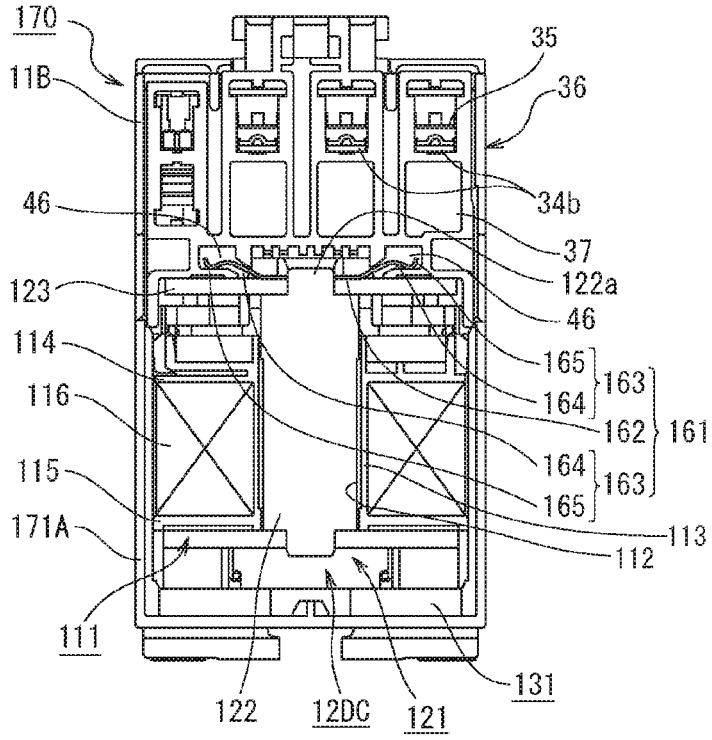
FIG. 18 is a cross-sectional view taken along the line XVIII-XVIII of FIG. 16.

As illustrated in FIG. 14, FIG. 17, and FIG. 18, the spool 111 has a cylinder portion 113 having a central opening 112 and radially protruding flange portions 114 and 115 at the end portions in the axial direction, that is, the top and bottom end portions, of the cylinder portion 113, respectively. An excitation coil 16 is wound between the flange portions 114 and 115 on the outer circumferential side of the cylinder portion 113. Further, coil terminals 117 to energize the excitation coil 16 are mounted.

As illustrated in FIG. 14, the plunger 121 includes a columnar bar-shaped portion 122 that is inserted into the central opening 112 of the spool 111 and a first armature 123 and a second armature 124 that are formed in a radially protruding manner at both end portions in the axial direction of the bar-shaped portion 122 that protrude from the central opening 112.

Figure 15:
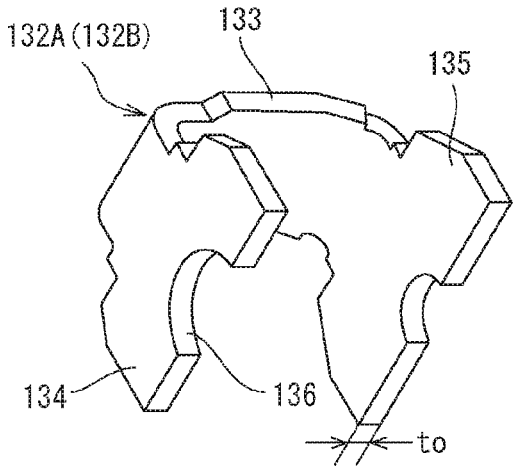
FIG. 15 is a perspective view illustrating a yoke half body of an outer yoke.

As illustrated in FIG. 12 and FIG. 14, the outer yoke 131 includes a pair of left and right yoke half bodies 132A and 132B that oppose each other across the spool 111. As illustrated in FIG. 15, each of the yoke half bodies 132A and 132B has a central plate portion 133 that extends frontward and rearward long an opposing side face of the spool 111 and opposite plate portions 134 and 135 that extend inward from the front and rear end portions of the central plate portion 133 along the flange portions 114 and 115 of the spool 111, and is formed in a U-shape when viewed from the side face.

As illustrated in FIG. 12 and FIG. 14, the inner yoke 141 includes yoke half bodies 142A and 142B that are arranged on the inner side of the yoke half bodies 132A and 132B of the outer yoke 131 with a predetermined space maintained therebetween. Each of the yoke half bodies 142A and 142B has a vertical plate portion 142 that opposes the central plate portion 133 of either the yoke half body 132A or 132B of the outer yoke 131 and a horizontal plate portion 144 that is arranged in a groove 115*a* formed on the bottom face side of the flange portion 115 of the spool 111 in a radially extending manner from the bottom end side of the vertical plate portion 143, and is formed in an L-shape.

As illustrated in FIG. 12 and FIG. 14, the permanent magnets 151 are individually arranged and interposed between the central plate portions 133 in the yoke half bodies 132A and 132B of the outer yoke 131 and the vertical plate portions 42 opposite thereto of the yoke half bodies 142A and 142B of the inner yoke 141. The outer side and the inner side of each permanent magnet 151 are magnetized to be the north pole and the south pole, respectively.

As illustrated in FIG. 12 and FIG. 14, each of the yoke half bodies 132A and 132B of the outer yoke 131 has the front opposite plate portion 134 arranged in a manner opposing the top end face of the flange portion 114 of the spool 111 and the rear opposite plate portion 135 arranged below the flange portion 115 of the spool 111 with a predetermined distance maintained therebetween. As illustrated in FIG. 15, on the opposite plate portions 134 of the yoke half bodies 132A and 132B, semicircular notches 36 through which the bar-shaped portion 122 of the plunger 121 is inserted are arranged.

The thickness "to" of the yoke half bodies 132A and 132B of the outer yoke 131 is set at, for example, 3.2 mm, and the thickness "ti" of the yoke half bodies 142A and 142B of the inner yoke 141 is set at, for example, 1 mm. Thus, each of the yoke half bodies 132A and 132B included in the outer yoke 131 is formed so that the thickness "to" becomes approximately three times the thickness "ti" of each of the yoke half bodies 142A and 142B included in the inner yoke 141.

As described above, by setting the thickness "to" of the yoke half bodies 132A and 132B of the outer yoke 131 to approximately three times the thickness "ti" of the yoke half bodies 142A and 142B of the inner yoke 141, it is possible to reduce the magnetic resistances of the yoke half bodies 132A and 132B of the outer yoke 131 to be smaller than the magnetic resistances of the yoke half bodies 142A and 142B. Thus, as will be described later, when the excitation coil 116 is energized to form the magnetic flux in a direction opposite to the magnetization direction of each permanent magnet 151, it is possible to suppress a reverse magnetic flux, which is magnetic flux passing in the direction opposite to the magnetization direction of each permanent magnet 151.

The minimum width of each of the yoke half bodies 132A and 132B of the outer yoke 131, that is, the width of one of constricted portions 137 that are formed at connection positions between the central plate portion 133 and the opposite plate portions 134 and 135 disposed at the front and rear end portions thereof, is set at 16 mm, and the cross-sectional area of one of the constricted portions 137, which has the minimum width, is set at 51.2 $mm^2$. The cross-sectional area at the minimum width is 1.7 times a cross-sectional area of 30.1 $mm^2$ at a minimum width of the outside yoke 101 having an identical thickness in the above-described conventional example.

As described above, by adjusting the thickness and width of the yoke half bodies 132A and 132B of the outer yoke 131 to set the cross-sectional area at a minimum width larger than that in the conventional example, it is possible to reduce the magnet resistances of the respective yoke half bodies 132A and 132B to be smaller than those in the conventional example illustrated in FIG. 21.

Further, the magnet resistances of the yoke half bodies 132A and 132B of the outer yoke 131 can be further reduced by applying a magnetic material having a sufficiently large relative permeability to the relative permeability of, for example, SPCC, which is a typical iron material having a relative permeability of approximately 200,000, such as a pure iron, and having a small magnetic resistance.

As described above, the magnetic resistance of the respective yoke half bodies 132A and 132B of the outer yoke 131 are reduced, so that the convergent magnetic flux formed at the plunger 121 can be diverged into the yoke half bodies 132A and 132B of the outer yoke 131 when the excitation coil 16 is energized, as will be described later. In addition, the balance of magnetic flux density between the plunger 121 and the yoke half bodies 132A and 132B of the outer yoke 131 can be optimized.

Accordingly, the electromagnet efficiency will be improved. When an identical operation force is tried to be available at the plunger 121, it is possible to reduce the number of windings of the excitation coil 116 to be wound around the spool 111. Thus, the polarized DC electromagnet 12DC can be downsized, and the cost reduction can be achieved, by setting a configuration of acquiring an operation force same as the AC electromagnet 12AC to have the same size as the AC electromagnet 12AC.

In addition, since areas, in the opposite plate portions 134 and 135 of the yoke half bodies 132A and 132B of the outer yoke 131, opposing the first armature 123 and the second armature 124 of the plungers 121 are set larger than the central plate portion 133, the magnetic resistance is made smaller and the magnetic flux between both of the yoke half bodies can be transmitted well.

Further, the thickness "to" of the outer yoke 131 is set to approximately three times the thickness "ti" of the inner yoke 141, and the magnetic resistance of the outer yoke 131 is set smaller than the magnetic resistance of the inner yoke 141. Hence, the magnetic flux of the reverse polarity of the permanent magnet 151, when the excitation coil 116 is made to be in an excitation state, can be prevented from flowing backward across the permanent magnet 151.

In addition, since the magnetic resistance of a magnetic body included in the outer yoke 131 is set smaller than the magnetic resistance of a magnetic body included in the inner yoke 141, the magnetic flux of the reverse polarity to the permanent magnet 151 can be prevented from flowing backward across the permanent magnet 151, as described above.

Figure 16:
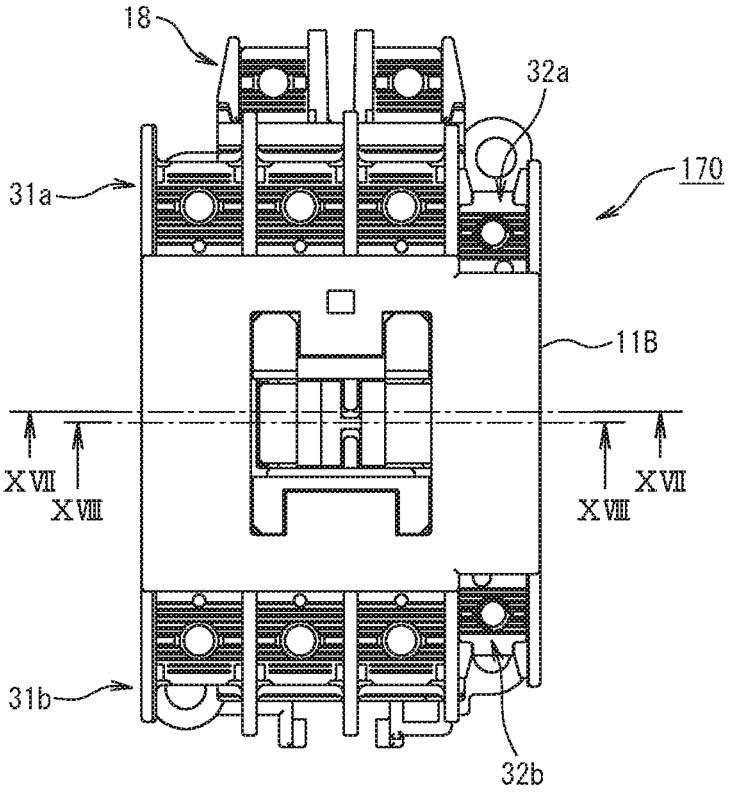
FIG. 16 is a front view illustrating an electromagnetic contactor in a state where the terminal cover is removed.

Then, at the first armature 123 of the polarized DC electromagnet 12DC, as illustrated in FIG. 16 and FIG. 17, the DC electromagnet coupling spring 161 is fixed at the front face thereof by caulking. The DC electromagnet coupling spring 161 includes a flat plate portion 162 at the central part, and curved plate portions 163 integrally formed on both end sides in the longer direction of the flat plate portion 162.

The flat plate portion 162 includes an insertion hole 162*a* that permits the insertion of an attachment projection 122*a* projecting from the central part of the first armature 123 that is arranged at an end part of the plunger 121.

The curved plate portion 163 includes a curved bulge portion 164 that bulges to be away from the front face of each of the first armatures 123 respectively arranged at both end parts in the longer direction of the flat plate portion 162, and an edge curved bulge portion 165 that curves in an opposite direction to each of the curved bulge portions 164 respectively arranged at the outer sides of the curved bulge portions 164. Here, each of the bottom faces of the edge curved bulge portions 165 is spaced apart from the surface of the first armature 123 at a predetermined distance, and can be accommodated in a coupling spring edge accommodation portion of the above-described contact support 36 with given elasticity.

The polarized DC electromagnet 12DC having the above configuration is coupled with the contact support 36. The polarized DC electromagnet 12DC is coupled with the contact support 36 by bringing the front face of the first armature 123 into contact with the armature contact portion of the contact support 36, and in addition, by attaching to bring the curved bulge portions 165 of the curved plate portions 163 of the DC electromagnet coupling spring 161 into contact, in a frontward bending manner, with the inner faces of the spring support plate portions in the coupling spring edge accommodation portions.

Then, in a state where the polarized DC electromagnet 12DC and the contact support 36 are integrated with the DC electromagnet coupling spring 161, as illustrated in FIG. 17 and FIG. 18, the polarized DC electromagnet 12DC is accommodated in a first frame 171A having an outer shape similar to the above-described first frame 11A. In this state, the electromagnetic contactor 170 can be configured by snap-fitting the above-described second frame 11B with the first frame 171A, so as to accommodate the contact support 36 slidably.

Thus, according to the present embodiment, since the edge curved bulge portion 165 of the DC electromagnet coupling spring 161 is supported by the spring support plate portion of the coupling spring edge accommodation portion of the contact support 36, the contact support 36 and the plunger 121 of the DC electromagnet coupling spring 161 can be integrated with the spring support plate portion of the contact support 36 being held by the elasticity of the DC electromagnet coupling spring 161.

Thus, according to the above-described embodiment, the movable core of the AC electromagnet can be integrally coupled with the contact support 36 by the AC electromagnet coupling spring, and in addition, the first armature 123 of the polarized DC electromagnet 12DC can be integrally coupled with the contact support 36 by the DC electromagnet coupling spring 161.

Therefore, the contact support 36 for the AC electromagnet and the contact supports 36 for the DC electromagnet do not have to be provided separately, the identical contact support 36 is capable of coupling either one of the AC electromagnet or the DC electromagnet, and it is possible to reduce the number of parts and to reduce the manufacturing cost of the electromagnetic contactor.

In addition, as described above, the number of windings of the excitation coil is reduced by improving the electromagnet efficiency of the polarized DC electromagnet 12DC, and the polarized DC electromagnet 12DC is further downsized to have an identical size to the AC electromagnet 12AC, so that an outer shape of the first frame 171A that accommodates the polarized DC electromagnet 12DC can be formed to have an outer shape identical to that of the first frame that accommodates the above-described AC electromagnet 12AC. Therefore, the second frame 11B can be commonly used, too, and it is possible to provide the electromagnetic contactor, the manufacturing cost of which can be further reduced.

It is to be noted that in the above embodiments, the description has been given of the case where the movable core contact portion 41 of the electromagnet coupling portion 40 is arranged in the direction that is perpendicular to the alignment direction of the moveable contacts 35. However, the present invention is not limited to this. The movable core contact portions 41 may be arranged in a direction crossing the alignment direction of the moveable contacts.

In addition, in the above embodiments, the description has been given of the case where the widths of the opposite plate portions 134 and 135 of the respective yoke half bodies 132A and 132B of the outer yoke 131 in the polarized DC electromagnet 12DC are configured to be larger than the width of the central plate portion 133. However, the present invention is not limited to this. In other words, in the present invention, the widths of the central plate portion 133 can be identical to those of the opposite plate portions 134 and 135, and the point may be keeping a large cross-sectional area in the smallest width.

In addition, in the above embodiments, the description has been given of the case where the thickness "to" of the outer yoke 131 is set to 3.2 mm and the thickness "ti" of the inner yoke 141 is set to 1 mm in the polarized DC electromagnet 12DC. However, the present invention is not limited to this. In other words, the thickness "to" of the outer yoke 131 and the thickness "ti" of the inner yoke 141 can be set arbitrarily. The point may be setting the thickness "to" of the outer yoke 131 to be larger than the thickness "ti" of the inner yoke 141, so that the balance of the magnetic flux density between the plunger 121 and the outer yoke 131 can be optimized.

In addition, in the above embodiments, the description has been given of the case where the first frame 11A that accommodates the AC electromagnet 12AC and the first frame 171A that accommodates the polarized DC electromagnet 12DC are formed to have identical outer shapes. However, the present invention is not limited to this. The first frame 11A and the first frame 171A may be formed to have different shapes.

REFERENCE SIGNS LIST

10 . . . electromagnetic contactor, 11A . . . first frame, 11B . . . second frame, 12 . . . operated electromagnet, 12F . . . stationary core, 12M . . . movable core, 12AC . . . AC electromagnet, 13 . . . contact point mechanism, 21 . . . bottomed square tubular portion, 30 . . . square tubular portion, 31*a* . . . power supply side terminal portion, 31*b* . . . load side terminal portion, 32*a*, 32*b* . . . auxiliary terminal portion, 34*a*, 34*b* . . . stationary contact, 35 . . . movable contact, 36 . . . contact support, 37 . . . moveable contact support portion, 40 . . . electromagnet coupling portion, 41 . . . movable core contact portion, 46 . . . coupling spring edge accommodation portion, 49 . . . spring support plate portion, 51 . . . armature contact portion, 56 . . . AC electromagnet coupling spring, 56*a* . . . flat plate portion, 56*b* . . . curved bulge portion, 56*c* . . . edge curved bulge portion, 111 . . . spool, 116 . . . excitation coil, 117 . . . coil terminal, 121 . . . plunger, 123 . . . first armature, 124 . . . second armature, 131 . . . outer yoke, 141 . . . inner yoke, 151 . . . permanent magnet, 161 . . . DC electromagnet coupling spring, 162 . . . flat plate portion, 163 . . . curved plate portion, 164 . . . curved bulge portion, 165 . . . edge curved bulge portion, 170 . . . electromagnetic contactor, 171A . . . first frame

The invention claimed is:

1. An electromagnetic contactor that is adapted to couple to a driving electromagnet when the driving electromagnet is an alternating current (AC) electromagnet including a movable core and an AC electromagnet coupling spring inserted into a through hole arranged on a mounting face of the movable core, and is also adapted to couple to the driving electromagnet when the driving electromagnet is a direct current (DC) electromagnet including an armature and a DC electromagnet coupling spring arranged at a contact face of the armature, the electromagnetic contactor comprising:

a contact support configured to hold a plurality of movable contacts in alignment to be coupled with the driving electromagnet and driven by the driving electromagnet, wherein the contact support comprises a coupling portion including, at a part of the electromagnetic contactor to couple to a coupling face of the electromagnet:

a movable core contact portion extending in a direction crossing an alignment direction of the plurality of movable contacts, and adapted to contact the mounting face of the movable core of the AC electromagnet when the driving electromagnet is the AC electromagnet and is coupled to the electromagnetic contactor;

coupling spring edge accommodation portions arranged on both sides of the movable core contact portion, at least the movable core contact portion and one of end parts in an extension direction of the movable core contact portion being opened; and armature contact portions arranged on opposite sides with respect to the movable core contact portion of the coupling spring edge accommodation portion, and adapted to contact the contact face of the armature of the DC electromagnet, when the driving electromagnet is the DC electromagnet and is coupled to the electromagnetic contactor.

2. The electromagnetic contactor according to claim 1, wherein the AC electromagnet coupling spring comprises:

a central plate portion to be inserted into the through hole, and curved plate portions to be accommodated in the coupling spring edge accommodation portions respectively arranged on both ends of the central plate portion, and the coupling spring edge accommodation portions are adapted to accommodate the curved plate portions.

3. The electromagnetic contactor according to claim 2, wherein each of the curved plate portions comprises:

a curved bulge portion arranged at each of the both ends of the central plate portion and configured to bulge on the movable core contact portion side; and an edge curved bulge portion integrally formed on an outer side of the curved bulge portion and configured to bulge on a reverse side to the curved bulge portion.

4. The electromagnetic contactor according to claim 3, wherein in the coupling portion, a partition, having an inclined face opposing the curved plate portion closer to the central plate portion, is arranged to protrude between the movable core contact portion and one of the coupling spring edge accommodation portions.

5. The electromagnetic contactor according to claim 2, wherein in the coupling portion, a partition, having an inclined face opposing a part of the curved plate portion that is closer to the central plate portion, is arranged to protrude between the movable core contact portion and one of the coupling spring edge accommodation portions.

6. The electromagnetic contactor according to claim 2, comprising the AC electromagnet as the driving electromagnet, wherein the AC electromagnet coupling spring is accommodated in the coupling spring edge accommodation portions, and the movable core contact portion is in contact with the mounting face of the movable core of the AC electromagnet.

7. The electromagnetic contactor according to claim 1, wherein the DC electromagnet coupling spring comprises:

a central plate portion in contact with the contact face of the armature to be in contact with the armature contact portion, and curved plate portions arranged respectively on both ends of the central plate portion and configured to curve such that central parts of the curved plate portions accommodated in the coupling spring edge accommodation portions are away from the contact face, and the coupling spring edge accommodation portions are adapted to accommodate the curved plate portions.

8. The electromagnetic contactor according to claim 7, wherein each of the curved plate portions comprises:

a curved bulge portion arranged at each of the both ends of the central plate portion and configured to bulge on the movable core contact portion side; and an edge curved bulge portion integrally formed on an outer side of the curved bulge portion and configured to bulge on a reverse side to the curved bulge portion.

9. The electromagnetic contactor according to claim 7, wherein in the coupling portion, a partition, having an inclined face opposing a part of the curved plate portion that is closer to the central plate portion, is arranged to protrude between the movable core contact portion and one of the coupling spring edge accommodation portions.

10. The electromagnetic contactor according to claim 7, comprising the DC electromagnet as the driving electromagnet, wherein the DC electromagnet coupling spring is accommodated in the coupling spring edge accommodation portions, and the armature contact portions are in contact with the contact face of the armature of the DC electromagnet.

11. The electromagnetic contactor according to claim 1, wherein in the coupling portion, a partition is arranged to protrude between the movable core contact portion and one of the coupling spring edge accommodation portions, and the partition has an inclined face facing partially outward and opposing the AC electromagnet coupling spring when the driving electromagnet is the AC electromagnet and is coupled to the electromagnetic contactor, or the DC electromagnet coupling spring when the driving electromagnet is the DC electromagnet and is coupled to the electromagnetic contactor.

12. The electromagnetic contactor according to claim 1, comprising the AC electromagnet as the driving electromagnet, wherein the AC electromagnet coupling spring is accommodated in the coupling spring edge accommodation portions, and the movable core contact portion is in contact with the mounting face of the movable core of the AC electromagnet.

13. The electromagnetic contactor according to claim 1, comprising the DC electromagnet as the driving electromagnet, wherein the DC electromagnet coupling spring is accommodated in the coupling spring edge accommodation portions, and the armature contact portions are in contact with the contact face of the armature of the DC electromagnet.

* * * * *